US008808047B2

(12) United States Patent
Knutson

(10) Patent No.: US 8,808,047 B2
(45) Date of Patent: Aug. 19, 2014

(54) PADDLEBOARD AND PROCESS

(76) Inventor: Eric Knutson, Granite Bay, CA (US)

( * ) Notice: Subject to any disclaimer, the term of this patent is extended or adjusted under 35 U.S.C. 154(b) by 144 days.

(21) Appl. No.: 13/410,304

(22) Filed: Mar. 2, 2012

(65) Prior Publication Data

US 2013/0231014 A1 Sep. 5, 2013

(51) Int. Cl.
*B63B 35/83* (2006.01)

(52) U.S. Cl.
USPC ..... 441/76; 441/77

(58) Field of Classification Search
USPC ..... 441/74, 77, 76
IPC ..... B63B 35/85,35/83
See application file for complete search history.

(56) References Cited

U.S. PATENT DOCUMENTS

| | | | | | |
|---|---|---|---|---|---|
| 3,084,356 | A * | 4/1963 | Wheat | 441/77 |
| 4,541,809 | A * | 9/1985 | Schaumann | 441/76 |
| 5,080,621 | A * | 1/1992 | Nayes | 441/77 |
| 5,236,381 | A * | 8/1993 | Keogh | 441/77 |

* cited by examiner

*Primary Examiner* — Stephen Avila

(57) ABSTRACT

A paddleboard (10) comprising a right board (12) slidingly connected to a left board (14). At least one interlocking sliding element is connected to the right board 12, and at least one interlocking sliding element is connected to the left board 14. Right board (12) and left board (14) are slidable longitudinally with respect to one another only within the plane of paddleboard (10), and parallel to the long axis of paddleboard (10). Utilizing a user's legs and feet to slide right board (12) and left board (14) longitudinally causes a propulsion system to propel paddleboard (10) over the water. A suitable propulsion system comprises pivoting paddles (16) or flaps (40) mounted under right board (12) and under left board (14).

3 Claims, 9 Drawing Sheets

PADDLEBOARD AND PROCESS

BACKGROUND

1. Field of Invention

This invention relates to human powered watercraft, and more particularly, to surfboards, paddleboards.

2. Description of Prior Art

Currently paddleboards are propelled on flat water by use of a handheld paddle or by direct hand-paddling from a prone or kneeling position. They have a simple design, and are readily portable.

Lifeguards have recently come to consider the stand up paddleboard as one of their most critical pieces of equipment. A first reason is that the speed of a stand-up paddleboard is greater than hand-paddling prone or kneeling on a surfboard. A second reason is the ability to visually survey an area of water that is much greater from the standing position than from a prone position. On heavy surf days, lifeguards now frequently stay out on the water patrolling from the paddleboard. A third reason is that paddleboard portability and deployment speed is comparable to surfboards. If, however, paddleboards could be even greater speed, their utility would be further enhanced.

The art shows many human powered watercraft designs. However, no prior designs are as readily portable as a paddleboard. Portability is especially important for rescue response time, but is also important for any user. Prior designs are large and heavy. They have parts that move independently in multiple planes, and that cannot readily be locked to form a unitary object for transport or use. They also do not readily fit onto popular roof racks, as do paddleboards. These issues make them awkward and time-consuming to transport.

Prior designs are relatively complex. Many have an excessive number of parts, and are generally costly to manufacture. Further, some require user assembly prior to the first use. Some require assembly and disassembly for transportation.

With prior designs, the rider is unable to position the feet in a preferred or natural paddleboard stance. The watercraft has limitations as to the number of available positions and stances. This is limiting for the rider, and he/she cannot vary the stance in response to constantly changing water conditions. Prior designs also do not permit a rider to use uniform, directional cross-country skiing striding mechanics required for powerful, efficient strokes. Further, many actually require substantial shifting of body weight during strokes, such as shifting the weight from right to left, or from fore to aft.

Many designs specify retentive bindings or foot wells to retain the feet. This foot retention is required to counter instability on the water that is inherent with the design. Bindings or foot wells are inconvenient, and increase the chance of injury to the rider's foot, ankle, or leg when the rider looses balance.

Prior designs are difficult to remount in the event of the rider falling off or capsizing the watercraft. The right and left halves of the craft are relatively free to pitch, yaw, and roll independently of each other. The movement of the halves is not limited to movement that is only within the horizontal plane of the watercraft. Further, the movement of the halves is not restricted to movement that is only along the long axis of the watercraft. Remounting is difficult when the right and left halves of the watercraft are not securely connected together to limit movement. The leverage required to pull the rider's body onto a freely moveable half of the craft is unusually difficult. If the watercraft utilizes a foot well or bindings, then the rider insert his/her feet into the bindings while attempting to balance on the freely moving halves.

Most prior watercraft are inherently unstable on the water. Many have right and left halves that are free to move in two, or all three, planes. The right and left halves are generally free to independently pitch, yaw, and roll. Even on calm water, the rider's balance must be continually shifted to compensate for the independent movement of the parts. The balancing issue is exaggerated on rougher water.

This shifting requires continual and substantial balancing on the part of the rider. Attention, balance, and strength are required just to keep the right and left halves in proximity, and directed forward. Substantial concentration and coordination are required to use the craft. For the recreational rider, casual use of the craft feels more like work than play. The instability has the overall effect of detracts from permitting the rider to use smooth, powerful strides to propel the craft. The shifting of balance makes forward progress inefficient, and increases the chance falling.

Prior designs do not substantially glide over the water surface as quickly and easily as a paddleboard, but rather plow through the water generating greater water resistance. This greater water resistance, coupled with the inability to use a powerful striding motion, causes prior craft to move slowly through the water. The water speed of the craft is slow. It is nearly impossible to catch a wave with a cumbersome watercraft. A slowly moving watercraft is ineffective for rescue operations, and impedes athletic and recreational riders.

Prior designs are very specialized. They are for use in a very specific manner only, and lack functional flexibility. Generally they do not have alternate uses, and especially alternate and complimentary uses that are well established.

The above human-powered watercraft suffer from a number of disadvantages:

(a) Paddleboard human propulsion comprises hand-paddling prone or using a handheld paddle
(b) Restricts a rider's stance
(c) Is unstable and requires substantial balancing
(d) Requires substantial concentration and coordination to use
(e) Riders have difficulty moving the halves with a full force stride
(f) Plows through the water rather than gliding over the water
(g) Does not have a rapid top water speed
(h) Substantial difficulty surfing a wave with the craft
(i) Difficulty remounting the craft
(j) Manner of use is restricted, and lacks complimentary uses
(k) Is heavy, large, or awkward in transport
(l) Requires assembly for use

SUMMARY

The present invention is a paddleboard that comprises separated right and left halves called the right board and the left board. The right board is slidingly connected to a left board. The right and left boards are slidable longitudinally with respect to one another within the horizontal plane of the paddleboard. The right and left boards are always aligned in the plane of the paddleboard. Further, the boards move only in a direction that is parallel to the long axis of the paddleboard.

The lateral distance between the boards is minimal, and is fixed by the sliding connection. As such, when a rider standing on the board alternately moves his/her legs and feet fore and aft in a striding motion, the right and left boards are caused to likewise move fore and aft via the sliding connection. The right and left boards have a plurality of paddles connected to the bottom surface to function as a propulsion means. The paddles are hinge-mounted so they can pivot as the board moves fore or aft.

The hinges are configured so that moving a board aft over the water causes each paddle to move down and away from the board to a deployed position. The deployed position is approximately vertical, and perpendicular to the plane of the board. The rotation of each paddle is limited so that the paddle rotation is stopped when the paddle is vertical by a stop means. The deployed paddle causes substantial drag to the board moving aft. A multiplicity of deployed paddles maximizes water drag for the board as the board moves backward over the water.

Conversely, moving a board fore causes each paddle to readily rotate aft on the hinge to a non-deployed position. In the non-deployed position, the paddle is approximately horizontal and parallel to the plane of the board. As such, the board easily glides forward over the water surface with minimal drag.

When the rider uses an efficient striding motion similar to cross-country skiing, the right and left boards alternately resist moving aft over the water, then readily glide fore over the water. The legs and feet are the primary force of propulsion for the paddleboard. As such, the paddleboard makes rapid headway, gliding over the water.

In another aspect, the process of the present invention comprises the steps of: utilizing a rider's legs and feet to alternately move a slidingly connected right board and a left board fore and aft in a direction that is substantially parallel to the longitudinal axis of a paddleboard, wherein the right board and the left board move only within the plane of the paddleboard, wherein the distance between the right board and left board is minimal and fixed, and wherein the alternating fore and aft movements of the right board and the left board powers a water propulsion means to cause the paddleboard to efficiently and rapidly glide forward over the water.

OBJECTS AND ADVANTAGES

It is an object of the present invention to make a human-powered paddleboard that:

(a) utilizes human propulsion means other than a handheld paddle or hand-paddling
(b) utilizes a rider's feet and legs to move right and left halves of the paddleboard
(c) glides over the water faster than standard paddleboards
(d) is usable in the same manner as standard paddleboards
(e) is useful for surfing
(f) facilitates forward-directed, and full-force, striding
(g) permits substantial range of stances
(h) permits rapid variation of stance
(i) is stable on the water
(j) has ease of use
(k) may be rapidly remounted
(l) is fun for recreational users
(m) has established alternative uses
(n) is generally as portable as standard paddleboards
(o) does not require assembly for use Further objects and advantages are to provide a paddleboard that has improved water rescue capabilities when compared to standard paddleboards. Still further objects and advantages will become apparent from a consideration of the ensuing description and drawings.

DRAWING FIGURES

In the drawings, closely related figures have the same number, but different alphabetic suffixes.

Reference Numerals in Drawings

| | | | |
|---|---|---|---|
| 10 | paddleboard | 12 | right board |
| 14 | left board | 16 | paddle |
| 18 | hinge | 20 | wing |
| 22 | stop | 24 | slider |
| 26 | channel | 28 | torpedo |
| 30 | stringer | 32 | lock |
| 34 | handle | 36 | sleeve |
| 38 | hole | 40 | flap |
| 42 | flange | 44 | frame |
| 46 | handheld paddle | | |

DESCRIPTION

FIGS. 1-8

According to one aspect, the invention provides a paddleboard that is longitudinally separated down the center to form a right board and a left board. The right and left boards are slidingly connected, wherein the right and left boards are slidable longitudinally with respect to one another within the plane of the paddleboard.

As such, when a rider standing on the board alternately moves his/her legs and feet fore and aft in a striding motion, the right and left boards are caused to move fore and aft with the feet via the sliding connection. Alternately sliding the right and left boards longitudinally causes a propulsion means to propel the paddleboard over the water.

Figure 1:
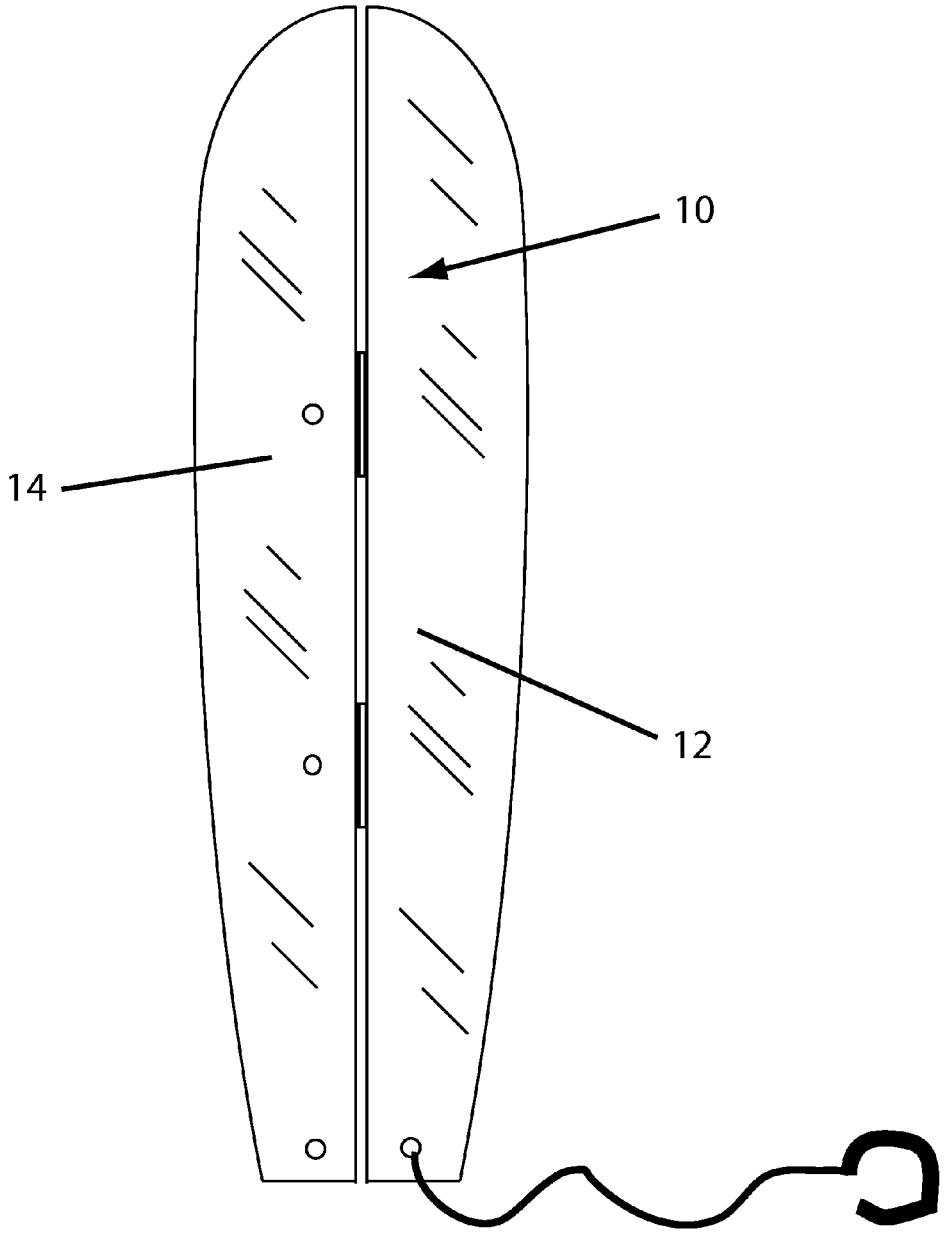
FIG. 1 is a top view of a paddleboard

FIG. 1 shows a paddleboard 10 that is longitudinally separated down the center to form a right board 12 and a left board 14. Right board 12 and left board 14 are slidingly connected, wherein right board 12 and left board 14 are slidable longitudinally with respect to one another within the horizontal plane of paddleboard 10. However, the lateral distance between right board 12 and left board 14 in the horizontal plane of paddleboard 10 is fixed by the sliding connection.

It is preferred that the lateral fixed distance between right board 12 and left board 14 is minimal. As such, the proximal edges of right board 12 and left board 14 are parallel. Right board 12 and left board 14 have only a small gap between them over their entire lengths in order to permit sliding without increased friction. The lack of a larger gap maximizes the locations the rider may stand on the deck without inadvertently catching the feet between the sliding right board 12 and left board 14. The term "deck" generally collectively includes the deck halves of the upper surfaces of right board 12 and left board 14.

When a rider standing on paddleboard 10 alternately moves his/her legs and feet fore and aft in a striding motion, right board 12 and left board 14 are caused to alternately move fore and aft with the feet via the sliding connection. The striding motion is most similar to cross-country snow skiing. When right board 12 and left board 14 move alternately in a reciprocal manner, right board 12 is moving fore when left board 14 is moving aft. When the rider reaches the end of his/her stride, he/she reciprocably reverses stride so that right board 12 moves aft and left board 14 moves fore.

The sliding connection slides with minimal frictional resistance so as to minimize resistance to the rider's striding movements. Sliding right board 12 and left board 14 longitudinally causes a propulsion means to efficiently propel paddleboard 10 over the water. The force of leg movements is transferred to the propulsion means via right board 12 and left board 14.

The sliding connection limits relative movement of right board 12 relative to left board 14 to movement in the horizontal plane. There is substantially no movement permitted in the vertical or transverse planes. Right board 12 and left board 14 are always aligned in the plane of the paddleboard. Further, the movement of right board 12 and left board 14 within the horizontal plane is limited to longitudinal movement substantially parallel with the longitudinal axis of paddleboard 10. Changes in the small lateral separation of right board 12 and left board 14 is not permitted.

This ensures that the relative movement between right board 12 and left board 14 will be smooth and directional. Right board 12 and left board 14 are not free to pitch, yaw, or roll independently of one another. With right board 12 and left board 14 securely connected, the pitch, yaw, and roll exhibited by paddleboard 10 is minimized, and paddleboard 10 exhibits the same high level of stability as standard paddleboards. The limited, smooth, and directional movement of right board 12 and left board 14 is intended to improve the rider's stability and balance on paddleboard 10.

While the stability of paddleboard 10 reduces the risk of capsizing, the directional movement of right board 12 and left board 14 also ensures that the rider is able to make smooth, deliberate, and powerful leg strokes. The rider is freed from using muscles and body mass for substantial balancing, and instead can dedicate the muscle activity to propulsion. The muscles are less distracted by balancing when the right board 12 and left board 14 are stabilized. The rider is able to focus weight and full muscle force is the forward direction. As such, paddleboard 10 facilitates forward-directed, and full-force, striding. The limited and directional movement of right board 12 and left board 14 improves the rider's stability and balance on paddleboard 10, and therefore increases the speed of paddleboard 10

On the top deck of paddleboard 10, the rider is substantially free to select any stance at any time, and is able to vary the stance for the best advantage in striding power. The deck is generally flat, and permits any foot placement the rider chooses. The stance is not limited to preset locations on paddleboard 10. Further, the rider can vary the stance instantly, and in rapid response to quickly changing conditions. The rider is therefore able to maximize balance and striding power by using an ideal and natural stance.

Maximizing striding balance and power ensures a faster response time in a rescue situation. It also ensures an effective workout for the exercising athlete, and ensures fun for the recreational rider.

The selectable stance combined with the overall configuration of paddleboard 10 also ensures that paddleboard 10 will possess the substantial stability of standard paddleboards.

The ability to vary the stance on the deck facilitates combining the water propulsion means of paddleboard 10 with the use of a handheld paddle. The rider can alternate striding with handheld paddling. This facilitates the rider's endurance and speed by alternately using the legs and arms for the primary propulsion. The rider may also handheld paddle while simultaneously striding. Blending handheld paddling with striding can increase the speed, endurance, and range for a rider.

A readily selectable stance also facilitates surfing with paddleboard 10. Ocean rescuers routinely practice surfing on standard paddleboards, and are expected to be able handle the standard paddleboard in the waves as part of improving rescue response. Surfing generally requires that the rider is able to shift the feet rapidly to any position on the paddleboard 10 deck. The ability to select any stance on the fly is crucial to paddleboard 10's viability as a surfing paddleboard.

It is preferred that the upper decks of right board 12 and left board 14 have foot-gripping, anti-slip, surface textures or materials. Such textures or materials further facilitate stable footing for the rider, similar to surfacing materials found on standard paddleboards.

Foot retention aids may be present on the deck of right board 12 and left board 14. Foot retention aids may be comprised of small ridges, recesses, fore and aft blocks, open foot shells, and so on. Such aids may be secured to the deck in a range of locations that are entirely optional to the rider, such as with Velcro, or other securing means. Alternatively, the deck may be covered with Velcro, and the rider may wear booties or sandals having Velcro pads for engaging the deck. Further, standard foot bindings may be utilized. Foot retention is most appropriate for racers or other competitive riders.

A paddleboard ankle strap is connected to the aft end of right board 12. Holes for housing a locking means are shown in the top surface of left board 14, wherein the locking means can unlockingly prevent the relative movement of right board 12 with respect to left board 14. A dent-resistant material may be used to surface the nose of right board 12 and left board 14, to enhance collision durability.

Paddleboard 10 is able to substantially glide over the water surface, as do standard paddleboards of the art. Many other watercraft have substantial draw in the water, and therefore encounter substantial drag as the watercraft plows through the water. Paddleboards and larger surfboards draw minimal water due to a favorable high surface area to low weight ratio. The surface area to low weight ratio of paddleboard 10 is comparable to paddleboards of the art, and is considered to glide over the water with minimal water resistance. Paddleboard 10 does not have substantial water draw, and does not plow through the water in a manner that encounters high water resistance.

Figure 2:
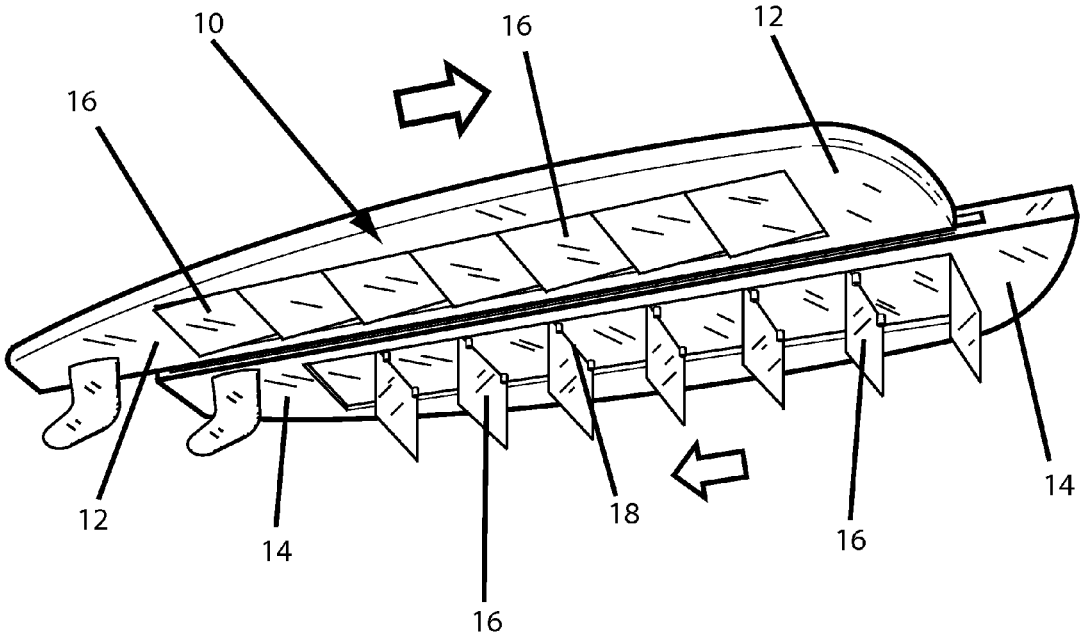
FIG. 2 is a perspective view of the paddleboard bottom surface

FIG. 2 shows the bottom surface of paddleboard 10. Paddles 16 line the bottom surface of right board 12 and left board 14. Paddles 16 function as a water propulsion means.

Each paddle 16 is connected to a hinge 18 so it can pivot as right board 12 and left board 14 alternately move fore or aft. Each paddle 16 is oriented on the bottom surface of right board 12 and left board 14 so that the axis of hinge 18 is perpendicular to the longitudinal axis of paddleboard 10.

Hinges 18 are configured so that moving right board 12 forward over the water causes each paddle 16 on right board 12 to readily rotate aft on hinge 18 to a non-deployed position, as shown in FIG. 2. The non-deployed position is approximately parallel to the plane of right board 12. For example, the distal end of a first paddle 16 is rotated up near the proximal end of a second paddle 16, and first and second paddles 16 are approximately horizontal.

Paddle 16 moves aft with minimal water resistance. In the non-deployed position, paddle 16 is approximately horizontal and parallel to the plane of right board 12. As such, right board 12 easily glides forward over the water surface with minimal drag. The minimal drag position maximizes the distance right board 12 slides forward over the water when the rider's leg pushes right board 12 to fore during a glide stroke.

As right board 12 is moving fore over the water, left board 14 is moving aft over the water. As left board 14 moves aft over the water, the water causes each paddle 16 to move down and away from left board 14 to a deployed position, as shown in FIG. 2. As left board 14 moves backward over the water, the movement of the water against the trailing edges of each paddle 16 causes the edges to engage the water. When the water engages the trailing distal edge of a paddle 16, the paddle 16 edge readily and automatically rotates the paddle 16 down and away from left board 14, and into the deployed position. Gravity also assists in the deployment rotation of paddles 16. The deployed position is approximately vertical, and perpendicular to the plane of left board 14. The rotation of each paddle 16 is limited so that the paddle 16 rotation is stopped when the paddle 16 is vertical.

In the vertical position, paddle 16 is deployed. A deployed paddle 16 causes substantial drag to left board 14 moving aft over the water. A multiplicity of deployed paddles 16 maximize water drag for left board 14 as left board 14 moves aft over the water. The water drag minimizes the distance that left board 14 slides backward over the water when the rider's leg pushes left board 14 to aft, called the power stroke.

When the rider reaches the end of his/her stride, the rider reverses direction for both legs, and begins to move left board 14 forward again. Each paddle 16 drags in the water, but hinge 18 allows paddle 16 to readily and automatically rotate back to the non-deployed position approximately parallel with the bottom surface of left board 14. Water drag is again minimized, and left board 14 glides freely over the water in a glide stroke. Simultaneously, the rider begins moving right board 12 aft in a power stroke. However, a manually operated linkage may be utilized to facilitate the movement of paddles 16 to the deployed and non-deployed positions.

The distance that right board 12 or left board 14 moves to aft over the water on the power stroke is substantially less than the distance that right board 12 or left board 14 moves to fore on the glide stroke. This is the case because paddleboard 10 is moving forward over the water.

During fore and aft movements of right board 12 and left board 14, right board 12 and left board 14 each travel the same distance relative to one another, and relative to paddleboard 10. However, the water resistance created by paddles 16 reduces the aft movement of right board 12 or left board 14. Therefore the distance right board 12 or left board 14 moves aft over the water is less than the distance right board 12 or left board 14 moves relative to one another.

Similarly, during the actual time of a given stroke, the distance right board 12 or left board 14 moves fore over the water is less than the distance right board 12 or left board 14 moves relative to one another. For example, if right board 12 moves 1 meter relative to left board 14, right board 12 will glide fore over the water less than 1 meter because left board 14 has move a small distance aft during the stroke.

When the rider uses a striding motion similar to cross-country skiing, right board 12 and left board 14 reciprocably drag aft over the water with high resistance on the power stroke, and easily glide fore over the water on the glide stroke with low water resistance. The striding motion has the overall result of moving paddleboard 10 efficiently over the water. The rider's legs and feet on the decks of right board 12 and left board 14 are the original or primary motive force for the propulsion of paddleboard 10. The force of deployed paddles 16 against the water is a secondary motive force of paddleboard 10 propulsion.

The efficient propulsion provided by paddles 16 enable paddleboard 10 to move over the water at a high rate of speed. The efficient paddle 16 propulsion and the selectable stance combine to make paddleboard 10 faster and more efficient than prior paddleboards or other human-powered watercraft. The quickness of paddleboard 10 enhances performance for rescue, racing, exercise, and recreation.

The fast water speed of paddleboard 10 also improves the chances of riders catching and surfing waves. Surfers have considerable difficulty achieving sufficient water speed to catch waves. The larger the wave, the greater the difficulty. A rider may rapidly propel paddleboard 10 into a wave in order to catch the wave by striding on right board 12 and left board 14, and also using a handheld paddle if preferred. The high water speed achievable on paddleboard 10 improves the chances of catching waves. Once the wave was caught, most riders would discontinue striding.

A further advantage for catching waves, riders can catch waves without having to jump up from a prone hand-paddling position to a standing position during the critical moments just prior to catching the wave. The rapid speed and selectable stance give paddleboard 10 ideal characteristics for paddleboard surfing. For the purposes of this discussion, a rider is considered to be a person who is actively propelling the paddleboard over the water utilizing a propulsion means such as paddles 16, a handheld paddle, or is surfing on a wave with paddleboard 10.

Paddles 16 shown in the non-deployed position are laying approximately parallel to the bottom surface of right board 12. More precisely, paddles 16 lay with distal edges overlapping the adjacent paddle 16 slightly, similar to roof shingles. Slight overlapping of paddle 16 edges facilitates deployment of paddles 16 because the edges are more exposed to the flowing water. The exposed edges of the overlapping paddles 16 have sufficient drag against flowing water such that the will catch the edge and rotate paddle 16 into the deployed position when right board 12 or left board 14 moves aft.

Multiple paddles 16 may be tethered together at or near the distal edge, such that if one or more of the paddles fail to deploy during a power stroke, the tether will be pulled into deployment position via the edges of multiple paddles 16 that are deploying. When the tether is pulled into deployment position, it will tend to pull any occasional lagging paddles 16 into deployment.

Each paddle 16 is generally oriented on the bottom surface of right board 12 and left board 14 so that the axis of hinge 18 is perpendicular to the longitudinal axis of paddleboard 10. However, it may be found that water flow dynamics permits greater overall water resistance when paddles 16 are oriented somewhat non-perpendicularly with respect to the longitudinal axis of paddleboard 10. Similarly, there may be efficiently gains if any one paddle 16 in an array of paddles 16 is not parallel to an adjacent paddle 16. Further, efficiency configurations of the paddles 16 edges may comprises a non-straight edge, or an edge that is curved in any plane.

In FIG. 2, near the stern, standard paddleboard fins protrude from the bottoms of right board 12 and left board 14.

Figure 3:
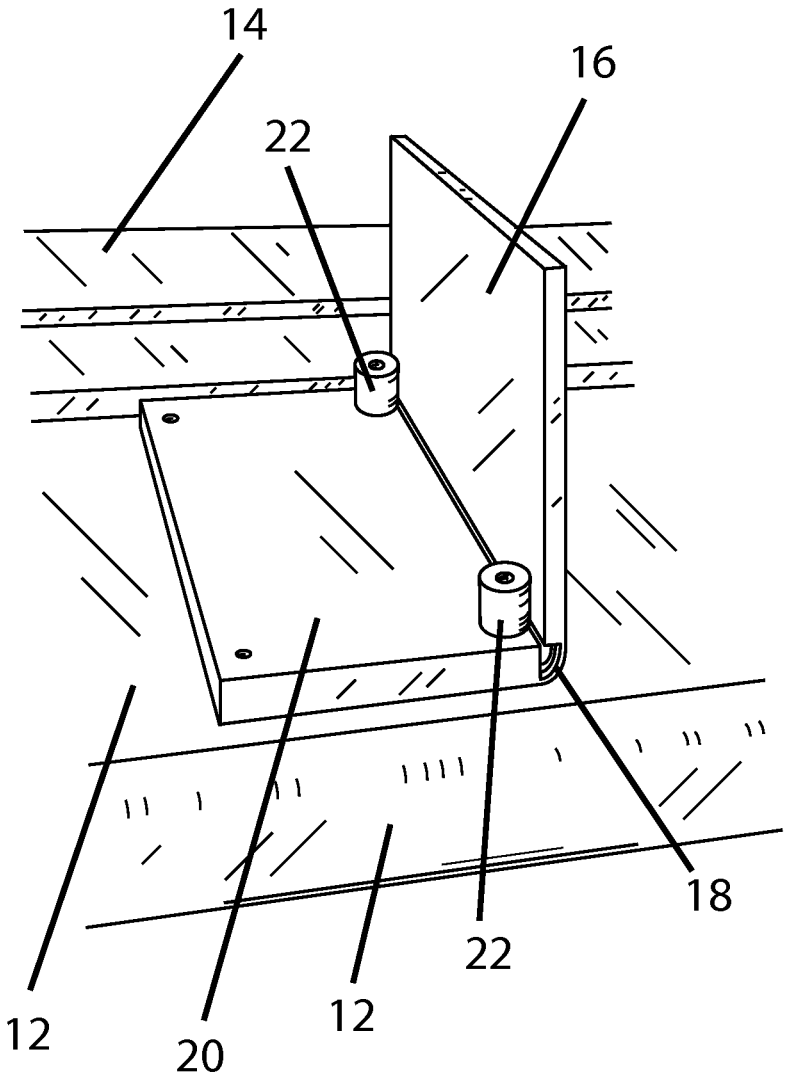
FIG. 3 is a perspective view of a paddle

FIG. 3 shows a paddle 16 and hinge 18 attached to the bottom surface of right board 12. It is preferred that hinge 18 comprises a living hinge configuration, having a pinless flex hinge made from polyethylene or polypropylene. However, hinge 18 may comprise a knuckle and pin bearing configuration.

Hinge 18 is connected to a wing 20. Wing 20 is connected to the bottom surface of right board 12. It is preferred that wing 20 is glued to right board 12. However, wing 20 may be glued to a liner that is glued to right board 12, screwed into right board 12 directly; screwed or riveted into a liner that is connected to right board 12, and so on.

The rotation of hinge 18 is limited by a stop 22*a*. Stop 22*a* functions as a mechanical means to provide a moment opposite to the moment of the rotating paddle 16. Stop 22*a* prevents paddle 16 from rotating beyond the deployed position during a power stroke.

Stop 22*a* shown comprises a cylinder connected to the surface of wing 20. However, stop 22*a* can comprise a raised edge of wing 20 that is proximal to hinge 18. When paddle 16 is rotated to the deployed position, the edge of paddle 16 that is proximal to hinge 18 butts up against the proximal edge of wing 20. The rotation of hinge 18 is stopped by contact between the respective edges of paddle 16 and wing 20. The edge of wing 20 and the edge of paddle 16 have a configuration and adequate thickness to function as stop 22*a*, and hold paddle 16 in the deployed position despite substantial water resistance forces.

Further, stop 22*a* may comprise a protrusion extending from the bottom of right board 12 or left board 14, a protrusion from the lower surface of wing 20 adjacent to hinge 18, a rotation restriction associated with the knuckle of hinge 18, anchored tethers attached to all paddles 16 on a board, and so on.

Alternatively, the proximal edge of paddle 16 may form the knuckle of a hinge 18. Further, the proximal edge of paddle 16 may form the knuckle of a hinge 18 and a stop 22*a*. Such a knuckle of hinge 18 may rotate about a pin connected to right board 12 or left board 14, eliminating the need for wing 20.

Figure 4:
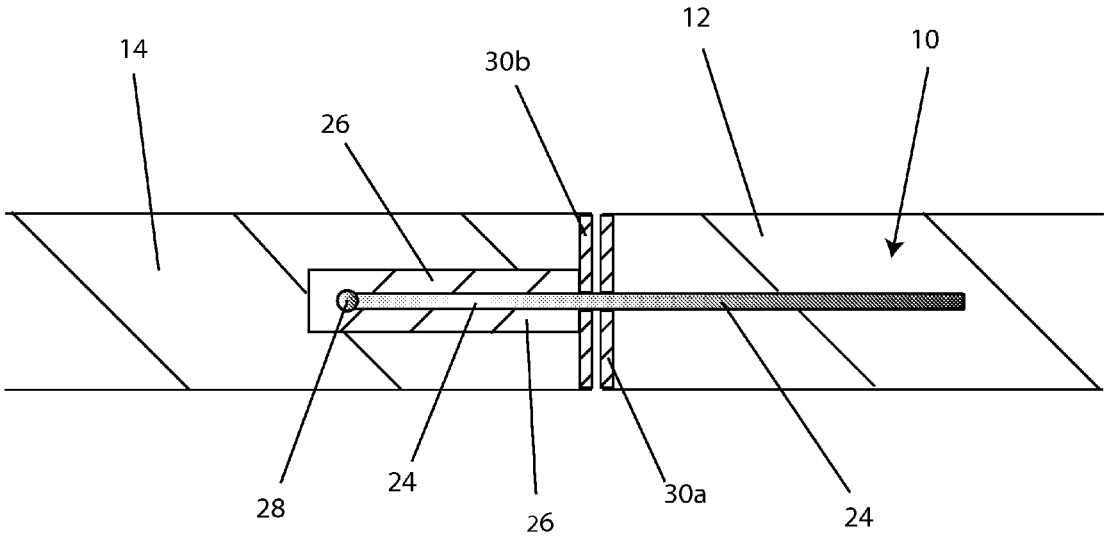
FIG. 4 is a cross-section view of an interlocking slider

FIG. 4 shows the aft edge of an interlocking sliding means, slider 24 inside a channel 26. Channel 26 is shown in cross-section. Slider 24 is affixed to right board 12 by being partially embedded into right board 12. Channel 26 is affixed to, and embedded within, left board 14. Slider 24 is slidingly nested within channel 26. Slider 24 is able to slide along a path within channel 26 that is parallel to the longitudinal axis of paddleboard 10.

When slider 24 is slidingly nested in channel 26, slider 24 is considered to slidingly connect right board 12 to left board 14. As such, right board 12 and left board 14 may slide longitudinally with respect to one another within the plane of paddleboard 10. When a rider standing on paddleboard 10 alternately moves his/her legs and feet fore and aft in a striding motion, right board 12 and left board 14 are caused to likewise move fore and aft via the sliding connection. Slider 24 slides within channel 26 with minimal resistance so as to minimize resistance to the rider's striding movements.

The sliding connection does not allow movement of right board 12 relative to left board 14 other than movement that is parallel to the longitudinal axis of paddleboard 10. There is substantially no movement permitted within the vertical or transverse planes, and no lateral movement in the horizontal plane. This movement limitation improves the rider's stability and balance on paddleboard 10.

It is preferred that slider 24 and channel 26 are comprised of high-strength, lightweight composite materials. It is further preferred that the contacting surfaces of slider 24 and channel 26 are comprised of low-friction materials so as to minimize resistance to the rider's striding movements. Suitable low-friction surfaces include Teflon®, nylon, polyoxymethylene, PVC, carbon fiber, and so on. However, slider 24 and channel 26 may be comprised of stainless steel, aluminum, and so on.

It is preferred that a torpedo 28 is connected to slider 24 for slidingly retaining slider 24 within channel 26. Torpedo 28 is retentively nested within an enlarged inner portion of channel 26 such that slider 24 may move along the horizontal plane in a longitudinal direction only, but not in a lateral direction. Slider 24 is unable to move laterally to the right or left in the horizontal plane. As such, torpedo 28 affixes the lateral distance between right board 12 and left board 14 in the horizontal plain of paddleboard 10, but permits longitudinal sliding. It is preferred that a fore torpedo 28 and an aft torpedo 28 are connected to slider 24, and that each torpedo 28 is approximately 6 inches in length.

Slider 24 and channel 26 may be readily separated so that right board 12 and left board 14 may be separated for compact transportation and storage of paddleboard 10. It is preferred that separation is possible via widened slots, or pullouts, at specific locations along the length of channel 26. When torpedoes 28 are aligned with the pullouts, the torpedoes 28 readily slide out through the pullouts, and slider 24 is thereby released from channel 26. Alternatively, channel 26 may be openable at the stern of left board 14 so that slider 24 and torpedoes 28 may be removed from channel 26 by sliding out the open stern end of channel 26.

The separability of right board 12 from left board 14 for enhanced portability or storage is a valuable feature of paddleboard 10. However, paddleboard 10 is substantially as compactly and conveniently portable and storable as paddleboards in the art when assembled, and without separation of right board 12 from left board 14. An assembled paddleboard 10 is as easily transported and stored as paddleboards in the art.

Other known interlocking sliding means are also effective, such as ball-bearing races configured to permit longitudinal sliding while fixing the lateral distance between right board 12 and left board 14, drawer slides, nesting rectangular tubes and channels, opposing channels, roller-coaster roller arrays, and so on.

A stringer 30*a*, shown in cross-section, is connected to the medial surface of right board 12, to increase the strength and flexural resistance of right board 12. A stringer 30*b* may also be connected to the medial surface of left board 14, to increase the strength and flexural resistance of left board 14.

Stringers 30*a* and 30*b* are comprised of lightweight materials having sufficient strength to support right board 12 and left board 14, such as nylon, balsa wood, PVC, Teflon, polyoxymethylene, carbon fiber, and so on. Stringer 30*b* on left board 14 may comprise an extended flange associated with channel 26. Stringer 30*a* and stringer 30*b* would each have a slot to accommodate the fore and aft movement of slider 24.

It is preferred that stringers 30*a* and 30*b* also provide protection for the respective interior opposing surfaces of right board 12 and left board 14 against bumping and chaffing that may occur during fore and aft movement due to the very close proximity of right board 12 and left board 14. However, the opposing surfaces of stringers 30*a* and 30*b* may be covered by resin, fiberglass, paint, and so on.

Figure 5:
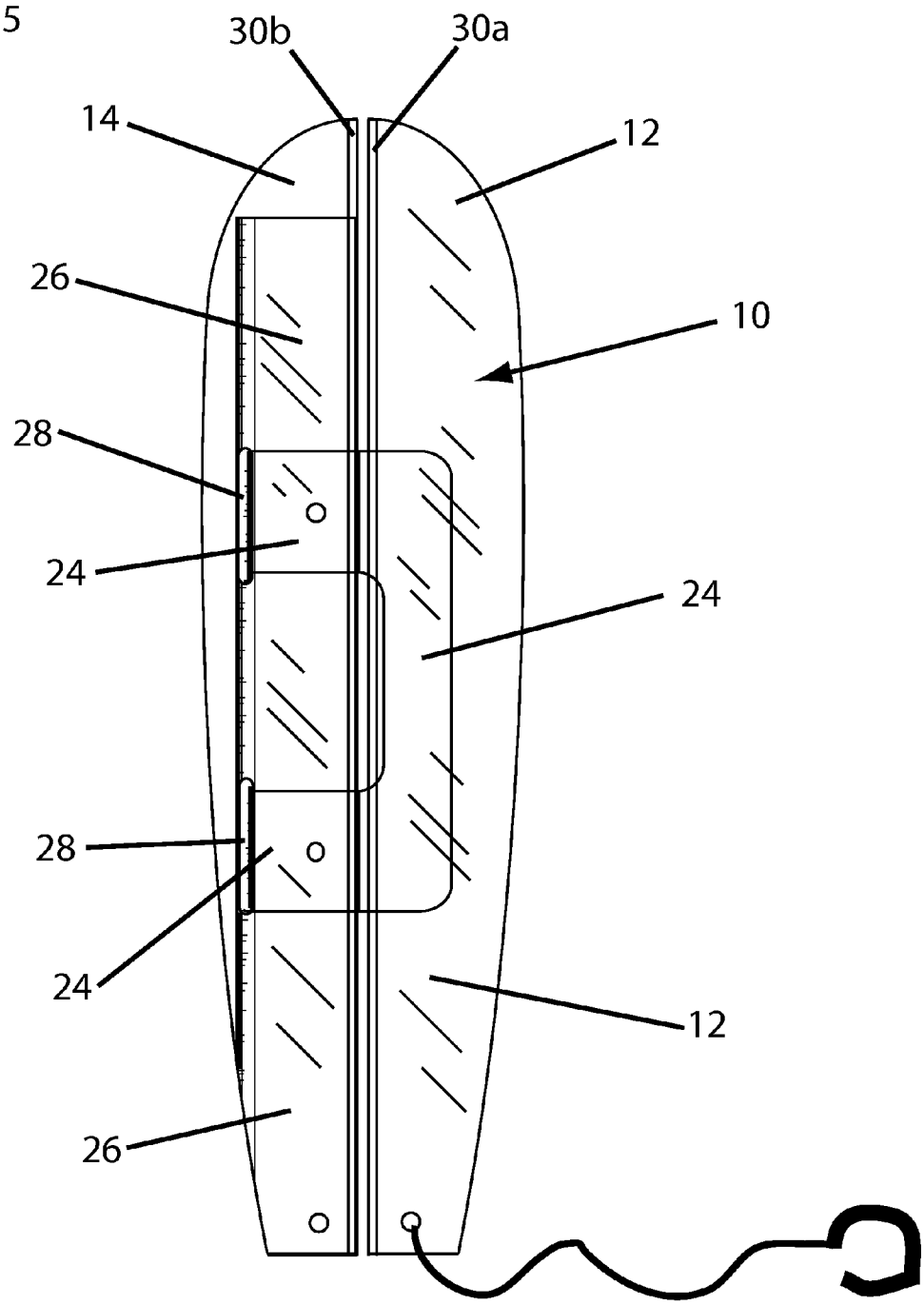
FIG. 5 is a transparency top view of a slider and channel in a paddleboard

FIG. 5 is a transparency view showing a slider 24 embedded within a transparent right board 12. Paddleboard 10 is shown as it would appear if constructed from a transparent material. The embedded portion of slider 24 is durably anchored into right board 12, such as by glue retention. It is also preferred that the embedded portion of slider 24 has surface retentive features to durably anchor slider 24 to right board 12, such as divots, holes, tabs, and so on. A paddleboard ankle strap is connected to the aft end of right board 12.

FIG. 5 also shows a transparent channel 26 embedded in a transparent left board 14. The left side of slider 24 is shown slidingly nested in channel 26. Two torpedoes 28 are shown connected to the fore and aft ends of slider 24.

Holes for a slider 24 locking means are shown in the top surface of left board 14. Stringers 30*a* and 30*b* are shown connected to the medial surfaces of right board 12 and left board 14, respectively.

Figure 6A:
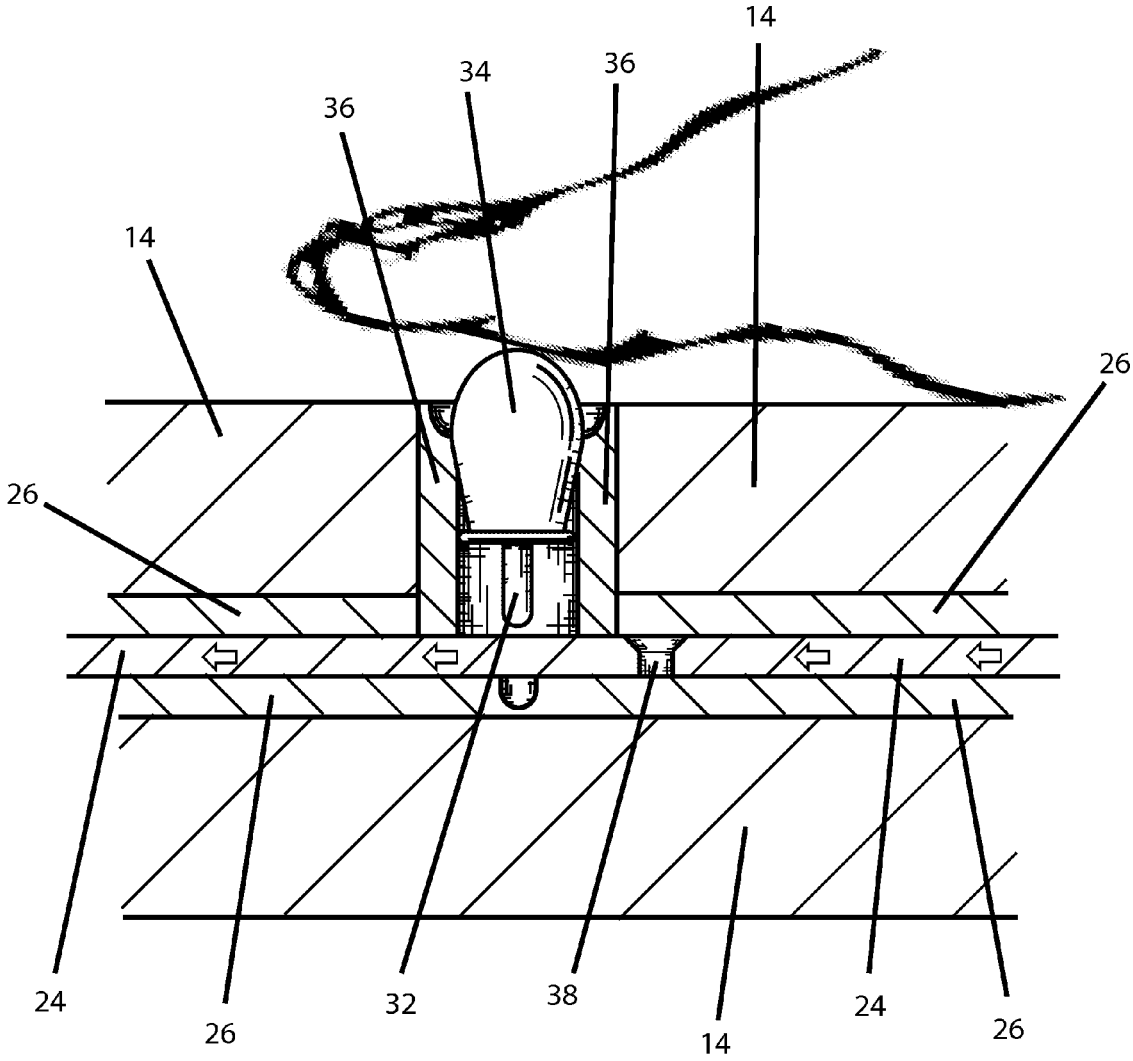
FIG. 6A is a cross-section view of an unlocked slider lock
Figure 6B:
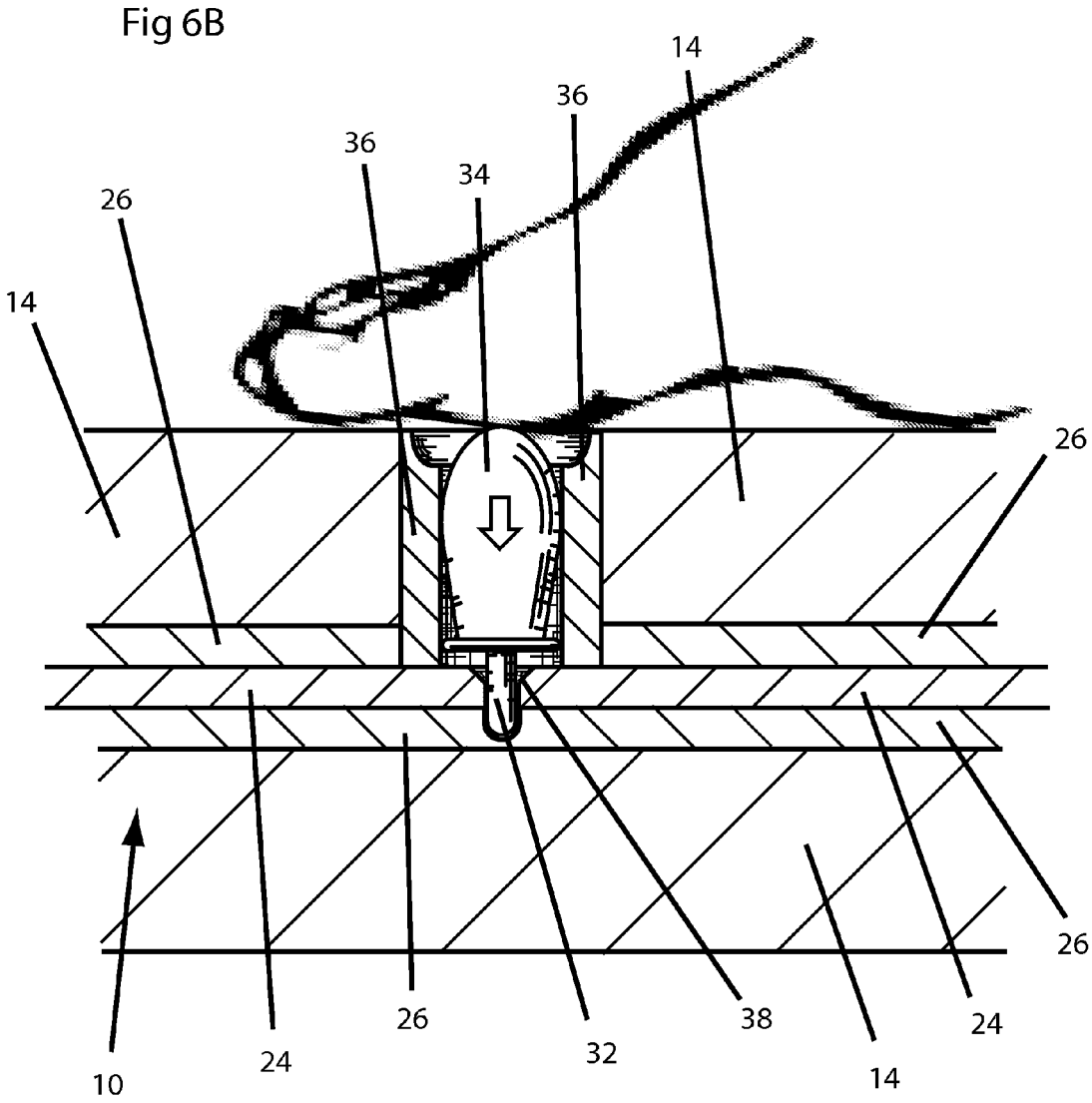
FIG. 6B is a cross-section view of a locked slider lock

FIGS. 6A and 6B show an unlockable locking means, lock 32, for releasably affixing slider 24 within channel 26, thereby releasably affixing sliding left board 14 and left board 14.

FIG. 6A shows a lock 32 penetrating through the deck of left board 14, and through the upper half of channel 26, where lock 32 is positioned in an unlocked position. When lock 32 is in the unlocked position, lock 32 is resting above, and slightly out of contact with, the upper surface of slider 24. In this position, lock 32 does not drag on the surface of slider 24, and thereby does not increase resistance to the sliding movement of slider 24.

Lock 32 is connected to handle 34. Handle 34 facilitates positioning the height of lock 32 relative to the surface of slider 24. Handle 34 is shown protruding up from the upper deck of left board 14 when lock 32 is in the unlocked position. Handle 34 is configured so that the rider may push or pull on handle 34 in order to vertically reposition lock 32.

Handle 34 is comprised of an elastomeric material. It is preferred that handle 34 is comprised of a buoyant elastomeric material, such that handle 34 and lock 32 could float on the surface of water.

Handle 34 is inserted into a cylindrical sleeve 36, wherein sleeve 36 is able to retain handle 34 at a variety of vertical positions within sleeve 36. The elastomeric material of handle 34 compresses when inserted into sleeve 36, so that handle 34 may be frictionally repositioned in the same manner as a bottle cork. Sleeve 36 has finger access areas along the upper end to facilitate grasping handle 34.

A hole 38 in slider 24 is shown unaligned with lock 32, so that lock 32 is not insertable into hole 38 should the rider happen to push down on handle 34.

It is preferred that handle 34 has a retentive feature to decrease the likelihood that handle 34 will inadvertently move upward and out of sleeve 36. If handle 34 were to inadvertently move out of sleeve 36, then lock 32 and handle 34 could fall out and be lost. A handle 34 retentive feature may comprise a ring of slightly greater diameter protruding from the lower end of handle 34. A sleeve 36 retentive feature may comprise a circumferential recess in the wall of sleeve 36 which corresponds with, and can engage, the protruding ring of handle 34. Other retentive features can include a spring-driven ball bearing lock, screw-threads, and so on.

It is preferred that a sleeve 36 recess is vertically located where it can engage the handle 34 ring when handle 34 is positioned in the unlocked position. The unlocked position is when lock 32 and handle 34 are at the greatest risk of loss.

FIG. 6B shows hole 38 aligned with lock 32, so that lock 32 is insertable into hole 38. The rider has aligned right board 12 and left board 14 into a position where hole 38 is aligned with lock 32, and has forcefully pushed down on handle 34 in order to push lock 32 down into hole 38. The rider can push handle 34 into sleeve 34 using a foot or hand, and thereby push lock 32 into hole 38.

Lock 32 is releasably engaged into slider 24, such that slider 24 is unable to slide longitudinally in channel 26. Lock 32 affixes slider 24 in channel 26. When lock 32 is engaged in a locked position in slider 24, then right board 12 is unable to slide longitudinally with respect to left board 14. Handle 34 is frictionally compressed into sleeve 36, such that handle 34 will not inadvertently slide upward to release lock 32 from slider 24.

At least one hole 38 for locking with lock 32 is located on slider 24 in a location that corresponds with the bow and stern of right board 12 and left board 14 being evenly aligned. In the evenly-aligned locked position, paddleboard 10 is symmetrical, such that the overall appearance resembles a standard paddleboard. In the symmetrically locked position, paddleboard 10 is configured for standard rescue, exercise, and recreational uses, including surfing.

Additional holes 38 may be present to affix right board 12 at other selected positions relative to left board 14. Lock 32 may also be used to prevent torpedoes 28 from inadvertently sliding into a channel 26 pullout slot, thereby preventing the inadvertent separation of right board 12 from left board 14.

Other locking means for releasably affixing sliding right board 12 and left board 14 are also effective, including automatic spring-activated pins, cams, levered brake pads, and so on. For example, when the rider rotates a lock knob in advance, a spring-activated pin will automatically pop into a hole 38 as right board 12 and left board 14 are then moved to the desired alignment.

Figure 7:
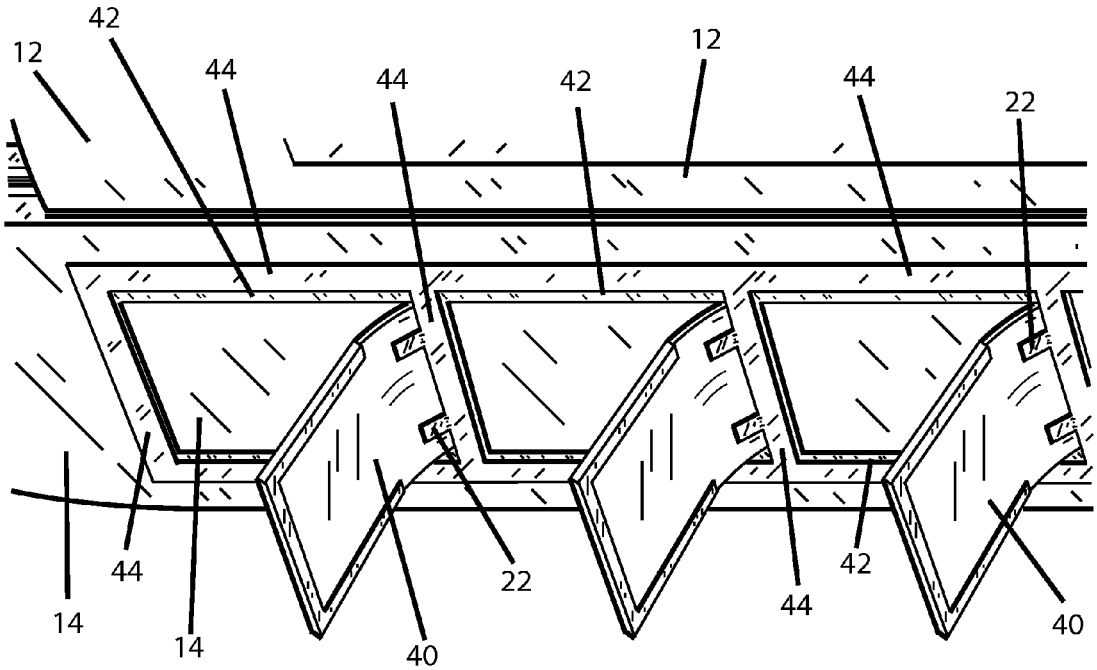
FIG. 7 is a perspective view of an array of flaps

FIG. 7 shows a plurality of alternative paddles, flaps 40. A flap 40 is comprised of an elastomeric sheet. The sheet is connected to an anchoring material, flange 42, and flange 42 is connected to the bottom of right board 12 or left board 14. The portion of the flap 40 sheet that connects to flange 42 is comprised of a material that is homogenous with the material substantially comprising the remainder of flap 40.

As such, flaps 40 functionally are living hinges, relying on the flexing of a portion of the elastomeric flap 40 material in order to permit rotation of flaps 40. The flexing of the elastomeric material functions in a hinge-like manner to allow each flap 40 to alternately rotate between a deployed position and a non-deployed position.

A flap 40 may be formed by making cuts into a larger sheet, such as by making cuts on three sides of a rectangular shape. Similarly, a flap 40 may be formed by cutting a 180 degree curvature into a larger elastomeric sheet, thereby forming a D-shaped flap 40.

Flange 42 comprises the remainder of the larger sheet from which flaps 40 are cut. Flange 42 surrounds an array of flaps 40. The sheet of elastomeric material comprising flange 42 is homogenous with the material comprising flaps 40. Flange 42 connects and anchors flaps 40 to the bottoms of right board 12 and left board 14. Flange 42 thereby maintains the position and orientation of flaps 40 with respect to right board 12 and left board 14. Flange 42 is anchored to the bottoms of right board 12 and left board 14, such as by snaps, interlocking tabs, locks 32, screws, pins, glue, and so on.

Flange 42 may be at least partly overlaid by a more rigid material that serves to anchor flaps 40 or flange 42 to right board 12 and left board 14. The rigid overlay may serve to reduce flexing or stretching of flaps 40 or flange 42. Flange 42 may be entirely connected to the bottoms of right board 12 and left board 14 via a connection to such an overlay, such as by snaps, interlocking tabs, locks 32, screws, glue, and so on. For the purpose of this discussion, flange 42, and any non-homogenous material overlaying flange 42, will be considered to be a part of, and included in, flange 42.

Flange 42 is configured to facilitate the water engaging the distal edges of flaps 40 to deploy flaps 40 during the power stroke. Flange 42 is configured to prevent flaps 40 from laying flush against the bottom of right board 12 or left board 14, such as by inadvertently laying into recessed areas bounded by flange 42, and from which flaps 40 were cut. If a flap 40 were to become inadvertently seated into the flange 42 recess, then the likelihood of the seated flap 40 engaging the water to deploy is greatly reduced.

For example, flange 42 may be reconfigured so that edges of flange 42 that are adjacent to flaps 40 are moved a small distance into the recesses so as to interfere with the distal edges of flaps 40 if they were tending to seat into the recesses. Further, flange 42 may be slit to facilitate moving a portion into the recesses to prevent seating of flaps 40. Yet further, protrusions may be connected to flange 42, connected to flaps 40, or connected to the bottom of right board 12 or left board 14, wherein the protrusions prevent flaps 40 from seating into the recesses of flange 42.

The hinges of flaps 40 can be manufactured with an elastic position memory that tends to prevent the seating of flaps 40 into the flange 42 recesses. Further, as flaps 40 are used, being repeatedly and forcefully pushed aft to the deployed position, the elastic memory of the deployed position will tend to inhibit inadvertent seating of flaps 40 into the flange 42 recesses.

A semi-rigid stiffening border may also be connected to the rims of flaps 40 to inhibit flaps 40 from seating into the recess, and also to limit losses in flaps 40 water-resistance caused by excessive flexing of the edges of flaps 40. The flexible material of flaps 40 may tend to flex too much at the edges, either at the distal edges, or along the lateral edges. This over-flexing can cause flaps 40 to partly loose valuable water resistance as the water slips too freely past the over-flexing edges. Materials added to reinforce the edges of flaps 40 can reduce such water-resistance losses, and increase the deployed paddling efficiency of flaps 40.

When water resistance pushes flaps 40 into the deployed position, the elastic limits of the connection between flaps 40 and flange 42 is reached, and further rotation beyond the deployed position is substantially stopped. Flange 42, and more specifically, the connection between flaps 40 and flange 42, thereby limits the rotation of flaps 40 beyond the deployed position. As such, the elastic properties of the material from which flaps 40 and flange 42 are comprised are selected to permit rotation of flaps 40 only to the deployed position, but resisting rotation beyond the deployed position.

A frame 44 is shown anchoring the perimeter of flange 42 to the bottom of right board 12 or left board 14. Frame 44 is connected to flange 42 and right board 12 or left board 14, such as by bolts, screws, pins, and so on. Frame 44 inhibits flange 42 and flaps 40 from pulling away from the surface of right board 12 or left board 14.

Frame 44 has struts crossing laterally over flange 42 between each flap 40. The frame 44 struts further inhibit flange 42 and flaps 40 from pulling away from the surface of right board 12 or left board 14. In addition, the struts are positioned to prevent flaps 40 from seating into the recesses of flange 42, so that the water will catch and rotate flaps 40 for deployment.

Stops 22*b* project from the aft side of the frame 44 struts to limit the rotation of the flap 40 located aft of the strut. Stops 22*b* shown are uniformly rigid, and the distal extensions of stops 22*b* make contact with elastomeric portion of flaps 40. However, stops 22*b* may include semi-rigid distal extensions, including extensions that make contact with a rigid or semi-rigid stiffening border about the edges of flaps 40. Stops 22*b* may also be hinged, elastomer coated, and so on. Alternatively, stops 22*b* may comprise anchored tethers connected to flaps 40 to limit the rotation.

In another variation, flaps 40 may be somewhat enclosed along their lateral sides, wherein such a laterally enclosed flap 40 forms a pouch. If flaps 40 are formed at least partly of an elastic material, the pouch may inflate somewhat with water during the power stroke, and deflate during the glide stroke.

The tendency of flaps 40 to stop rotation at the deployed position is influenced by multiple factors. A given degree of hinge rotation is dependent upon current hinge-area elasticity, the size and shape of the flaps 40, and upon the variable amount of force that a given rider is able to exert upon right board 12 or left board 14, and therefore on the amount of force exerted by the water against flaps 40. As such, the degree of flaps 40 rotation may fluctuate between under-rotated relative to an ideal deployment rotation, and over-rotated. Both over-rotation and under-rotation will decrease the water-resistance efficiency of flaps 40.

Further, the hinge-area elasticity is subject to change over time. A well-used flap 40 may increase elasticity such that it over-rotates at lower water forces than it did previously. An older, underused flap 40 may become stiff and oxidized, and may under-rotate. It is therefore preferred that an array of flaps 40 and flange 42 is conveniently rider replaceable. As such, a rider may quickly change flaps 40 and flange 42 to a greater or lesser elasticity that more exactly fits the rider's forceful exertion level. Further, a rider may quickly and conveniently replace an array of flaps 40 or flange 42 that has become worn or damaged, or otherwise is negatively affecting the performance of paddleboard 10. Flaps 40 and flange 42 may be changed by disconnecting any snaps, interlocking tabs, locks 32, screws, pins, and so on, that are connected to right board 12 or left board 14.

Figure 8:
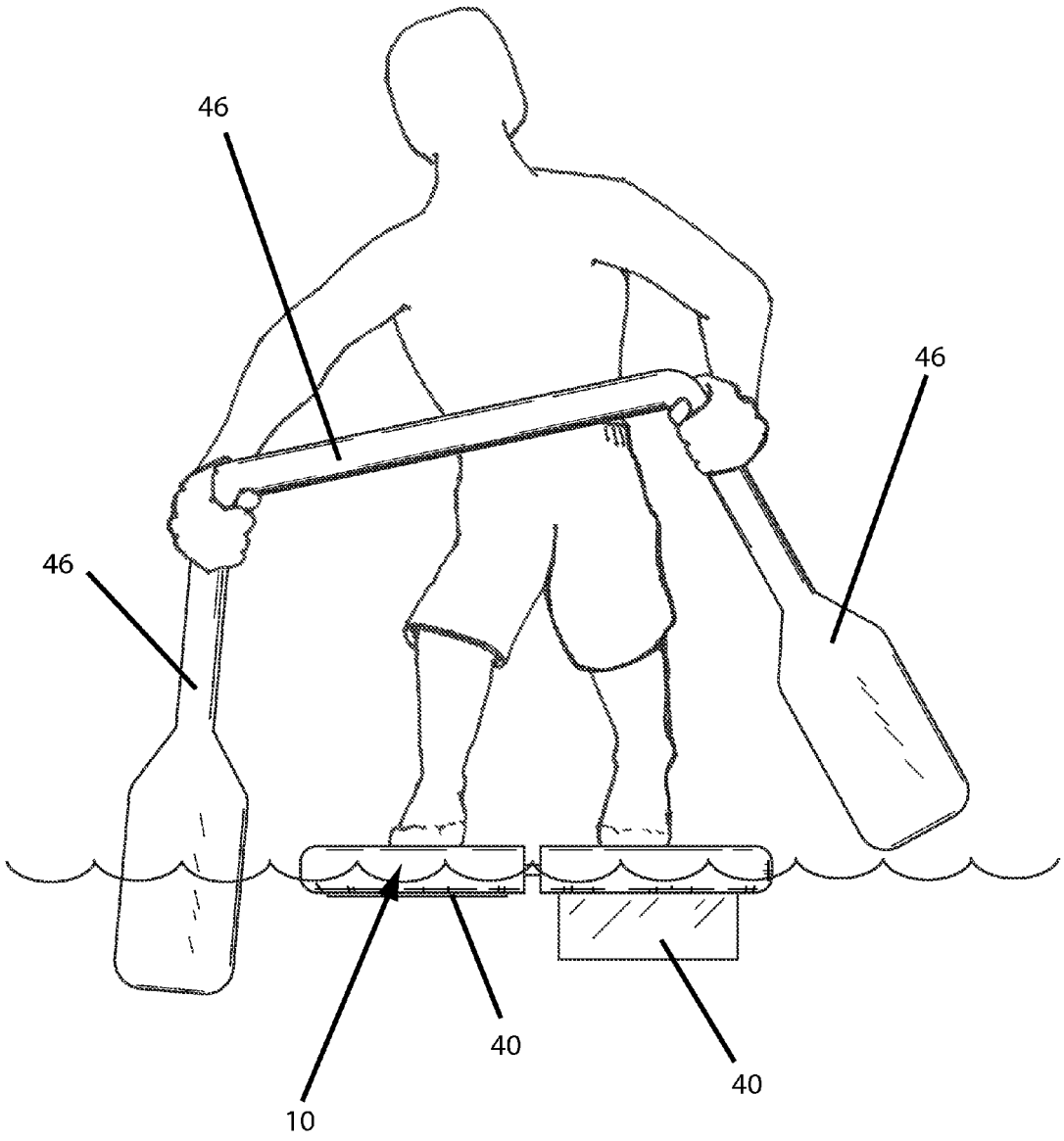
FIG. 8 is a perspective view of a handheld paddle

FIG. 8 shows a handheld paddle 46. Handheld paddle 46 is a double-ended paddle, wherein the handle of handheld paddle 46 is bent such that the right paddle is oriented at approximately a right angle with respect to the left paddle. During use, the right and left paddles of handheld paddle 46 remain close to the water even when the opposite paddle is stroking in the water.

From the horizontal position, handheld paddle 46 is rotated approximately 15-20 degrees to dip the end paddle into the water. The total rotation from right to left during active paddling is therefore about 40 degrees.

Handheld paddle 46 facilitates coordinating paddle strokes with a rider's strides, and enhances a rider's balance and striding power on paddleboard 10. With the paddle-to-water distance reduced, the rider stroke movement distance is reduced. Therefore, the time between paddle strokes is also reduced, and riders can easily increase their rate of paddle strokes. Handheld paddle 46 can thereby increase the overall water speed and stability of paddleboard 10. Further, the angulation can improve the rider's leverage on the paddle handle.

Handheld paddle 46 is considered an integral part of paddleboard 10 because of the unusual rider balancing required during forceful striding. Handheld paddle 46 is important and necessary for enhancing rider stability.

Handheld paddle 46 improves the level of cardio exercise attainable with paddleboard 10, or with other paddleboards. Further, handheld paddle 46 reduces the twisting and bending required by a rider for handheld paddling. Reduced twisting can increase rider endurance, and reduce muscle strain.

The handheld paddle 46 handle bend may comprise a single curvature or bend, or a plurality of alternating bends and straight portions. The total angle change of the bend may be somewhat more or less than 90 degrees. The center connector may provide a plurality of relative angles for the right and left paddles, so that the angulation of the right and left paddles may be lockingly selectable.

Alternatively, handheld paddle 46 may be constructed by attaching two standard handheld paddles to an angled center connector.

A flap 40 is shown deployed under paddleboard 10.

From the description above, a number of advantages of paddleboard 10 become evident. Paddleboard 10:

(a) utilizes a rider's feet and legs to propel the paddleboard
(b) glides over the water faster than standard paddleboards
(c) is usable in the same manner as standard paddleboards
(d) is useful for surfing (e) is useful for water rescue operations
(f) has improved water rescue capabilities over standard paddleboards
(g) facilitates forward-directed, and full-force, striding
(h) permits substantial range of stances
(i) permits rapid variation of stance
(j) is stable on the water
(k) has ease of use
(l) is fun for recreational users
(m) may be rapidly remounted
(n) has established alternative uses
(o) is generally as portable as standard paddleboards
(p) does not require assembly for use Operation According to another aspect, the invention provides a process comprising the steps of: utilizing a rider's legs and feet to reciprocably move slidingly connected right board 12 and left board 14 fore and aft in a direction that is substantially parallel to the longitudinal axis of paddleboard 10, wherein right board 12 and left board 14 move only within the plane of paddleboard 10, wherein the distance between right board 12 and left board 14 is minimal and fixed, and wherein the alternating fore and aft movement of right board 12 and left board 14 powers a water propulsion means that propels paddleboard 10 efficiently and rapidly forward over the water.

The invention provides a preferred process comprising the steps of: utilizing a rider's legs and feet to alternately move slidingly connected right board 12 and left board 14 fore and aft in a direction that is substantially parallel to the longitudinal axis of paddleboard 10, wherein right board 12 and left board 14 move only within the plane of paddleboard 10, wherein the distance between right board 12 and left board 14 is minimal and fixed, and wherein moving right board 12 or left board 14 aft causes paddles 16 to rotate to a maximum water resistance position, and moving right board 12 or left board 14 fore on the water causes paddles 16 to rotate to a minimum water resistance position, thereby propelling paddleboard 10 to efficiently and rapidly glide forward over the water.

By using the paddleboard of the invention, it is now possible, surprisingly, for a standing rider to utilize leg and foot strength to achieve faster paddleboard speeds. The process offers the advantage that the user can now propel a paddleboard simply and rapidly using leg strength.

In a further embodiment of the invention, there are multiple applications of the method for propelling paddleboard 10 by forcefully sliding right board 12 and left board 14 in a reciprocating, striding motion.

EXAMPLE 1

A paddleboard 10 is garage-stored in a bag, and oriented so that paddles 16 tend to rest in the non-deployed position rotated against the bottom of right board 12 and left board 14. When paddleboard 10 is standing on the stern, or lying flat with upper deck down, then gravity tends to rotate paddles 16 toward the non-deployed position.

One lock 32 is engaged in a hole 38 so that right board 12 and left board 14 are affixed to one another. As such, paddleboard 10 may be carried as a solid object. Paddleboard 10 is picked up by the rider and moved to a vehicle as easily as the other standard paddleboards commonly used by the rider.

The rider elects to remove paddleboard 10 from the bag for transportation, against manufacturer recommendations. Paddleboard 10 is strapped onto a car roof-rack so that the bow faces the front of the car, along with a handheld paddle 46. As paddleboard 10 is driven to the water, the wind tends to push paddles 16 against the bottom surface of right board 12 and left board 14 so that they remain in a non-deployed position.

Upon arrival at a race location, the rider places paddleboard 10 on the water, and climbs onto the deck with handheld paddle 46. The rider leaves lock 32 engaged in hole 38 so that slider 24 remains affixed to channel 26, and paddleboard 10 thereby remains in a standard paddleboard configuration. As the starting gun sounds, the rider quickly outpaces the other racers by producing many more handheld paddle strokes with handheld paddle 46 than other racers using standard standup paddleboard paddles, or kayak paddles. Paddleboard 10 is as stable on the rough water as the other paddleboards in the race.

When the rider has progressed well in front of the other racers, and sufficiently out of range of their view, the rider grasps handle 34 with her fingers and lifts it up just sufficiently so that lock 32 is disengaged from hole 38 in slider 24. However, handle 34 remains securely inserted into sleeve 36. In the disengaged position, the distal end of lock 32 is suspended just above, and out of contact with, the upper surface of slider 24. The proximal upper end of handle 34 protrudes somewhat above the surface of right board 12. Slider 24 is thereby unlocked to slide freely in channel 26.

The rider begins taking forceful and deliberate strides with her legs and feet. The force of the leg and feet movement is transferred to right board 12 and left board 14. When right board 12 is moved aft on the power stroke, the water moving past the distal edges of paddles 16 engages paddles 16 and rotates them down into the deployed position. The rotation of each paddle 16 is interrupted by contact with a stop 22 when paddle 16 has a vertical orientation, perpendicular to the plane of paddleboard 10. The deployed paddles 16 cause substantial resistance to further aft movement of right board 12, and the aft movement of right board 12 slows substantially.

Simultaneously, left board 14 is moved fore, and paddles 16 are rotated up against the bottom surface of left board 14. With this orientation of paddles 16, left board 14 readily glides fore over the water with little resistance.

At the end of the rider's stride, the rider reverses the direction of the stride. Left board 14 begins to move aft, and paddles 16 under left board 14 deploy to the vertical position. The movement of left board 14 to aft immediately slows in the face of substantial water resistance against deployed paddles 16. Right board 12 begins to move fore, and paddles 16 under right board 12 rotate back to a horizontal, non-deployed position. Right board 12 readily glides fore.

Whenever right board 12 or left board 14 moves aft, the movement is slowed by water resistance. Whenever right board 12 or left board 14 moves fore, the movement experiences minimal water resistance, and right board 12 or left board 14 moves fore easily and rapidly. The net result is that paddleboard 10 makes headway easily and rapidly.

Slider 24 readily slides through channel 26, permitting right board 12 and left board 14 to slide fore and aft along the longitudinal axis of paddleboard 10 with little frictional resistance. Right board 12 and left board 14 are held in close proximity during sliding because torpedoes 28 prevent slider 24 from moving laterally within channel 26. The plane of the upper decks of right board 12 and left board 14 respectively therefore do not change angulation, but rather remain at a fixed angle. The rider is presented with essentially a flat and solid deck similar to other paddleboards, with the exception of the fore and aft reciprocal sliding. The rider is able to remain standing on the stable, flat deck despite waves.

With an unusual wave, the rider is thrown into the water. She quickly regains the flat and stable deck, stands, places her feet in a comfortable stance, and begins striding again, loosing little time.

When the rider paddles with handheld paddle 46 while simultaneously striding on right board 12 and left board 14, the speed of paddleboard 10 increases further. The rider arrives at the race finish in record time, and is declared the winner. However, after inspection of paddleboard 10, an asterisk is placed in the record book by the rider's name, and a new classification is created for the organization's future paddleboard races.

At the end of the day, the rider's winning paddleboard 10 is still being viewed while the other race paddleboards are being been loaded into provided trucks. When organizers finally attempt to load paddleboard 10, they discover that the last space remaining in the truck is too small. The rider elevates a lock 32 at the stern, and any other lock 32, releasing slider 24 to move past the stern lock 32. The rider separates right board 12 from left board 14 by sliding slider 24 aft out the stern end of channel 26. Once separated, right board 12 and left board 14 fit together into the last remaining space on the truck for the ride back to the starting area.

EXAMPLE 2

A lifeguard is patrolling a beachfront area by standing on a paddleboard 10 out beyond a surf break. The stability of paddleboard 10 permits reliable and stable standing despite significant wave activity.

The lifeguard is moving paddleboard 10 over the water using a standard handheld paddle. He is simultaneously using a slow alternating leg striding motion to cause right board 12 and left board 14 to reciprocably slide fore and aft, thereby causing flaps 40 to propel paddleboard 10 forward over the water.

The lifeguard becomes aware of a potential rescue situation involving a swimmer down the beach, but nearer to the shore. He simultaneously increases the speed and force of the handheld paddling and the reciprocal sliding of right board 12 and left board 14 to accelerate paddleboard 10 to a high water speed. He directs paddleboard 10 diagonally toward the beach.

As paddleboard 10 moves over the water, the lifeguard watches incoming waves. At the right moment, powerful and directed striding movements power paddleboard 10 into an oncoming wave to catch the wave. As paddleboard 10 catches the wave, the lifeguard slides his foot over the top of handle 34 and uses his foot to push lock 32 down into light contact with slider 24. Maintaining downward pressure on handle 34, he slides right board 12 and left board 14 to bring their bow ends into even alignment until hole 38 is aligned with lock 32. As soon as hole 38 is aligned with lock 32, the downward pressure maintained on handle 34 pushes lock 32 into hole 38, thereby affixing slider 24 in channel 26. Right board 12 and left board 14 are lockingly affixed in side-by-side alignment so that paddleboard 10 has a non-sliding configuration that is similar to standard paddleboards.

The lifeguard rapidly surfs paddleboard 10 as close to the swimmer as possible, and then turns out of the wave. The lifeguard reaches down and pulls handle 34 up to the unlocked position. Immediately after unlocking slider 24, he immediately resumes forceful striding and handheld paddling to close the remaining distance to the swimmer.

As paddleboard 10 approaches the distressed swimmer, the lifeguard again presses down on handle 34, aligns the bows of right board 12 and left board 14, and presses lock 32 into hole 38 to affix right board 12 to left board 14. Paddleboard 10 is fixedly locked to enhance its stability while the lifeguard engages the swimmer.

After the rescue, with paddleboard 10 back at the lifeguard station, the rider determines that he needs a heavy-duty array of flaps 40 having a greater elastic resistance to deformation. He thinks this will better match his strength, and thereby provide additional water-speed. He selects two heavy-duty frames 40 that have greater resistance to deformation. He pulls the pins connecting the original frames 40 to right board 12 and left board 14, and removes the two original frames 40 from paddleboard 10. He secures the pins to connect a first heavy-duty flange 42 to right board 12 and a second heavy-duty flange 42 to left board 14. During subsequent uses of paddleboard 10, the rider achieves higher average water-speeds with the heavy-duty frames 40 connected.

Conclusion

In conclusion, paddleboard 10 is functionally flexible. Paddleboard 10 is ideal for established and popular uses of, and in the same manner as, paddleboards of the art for rescue, racing, surfing, paddling, exercising, and other recreation.

However, paddleboard 10 is also usable in manners unique to paddleboard 10, such as rescue, racing, surfing, paddling, exercising, and other recreation at a uniquely high water speed. Paddleboard 10's speed, striding motion, and stance facilitate an increased distance range and endurance for riders.

Paddleboard 10 also provides a uniquely high level of cardio-stimulation, endurance, and general performance achievable by a rider. A cross-country skiing motion, like that utilized on paddleboard 10, is known to be a particularly effective exercise type. Paddleboard 10 is an ideal device for enhancing general athletic performance and balance.

The portability, simplicity, and low cost of paddleboard 10 make it a viable transportation means for people in remote areas, or for people with limited means. Paddleboard 10 may be used for personal transportation, for transporting limited goods onboard, or for towing goods, such as goods towed on a trailing board.

Overall, paddleboard 10 is a novel watercraft. Paddleboard 10 is fairly simple to manufacture, and can be sold at costs comparable to standard paddleboards. The use of paddleboard 10 is straightforward, making it useful for rescue, racing, exercise, or just for fun. These factors make paddleboard 10 economically viable.

Alternate propulsion means may be utilized in lieu of paddles 16. For example, a rotating propeller could be powered via linkages connected to reciprocating right board 12 and left board 14 that converts the reciprocating movement to rotate a propeller axle. Other propulsion means includes linkage connected to a paddlewheel, a fish tale or whale tail stern paddle, lateral paddles, and so on.

Such configurations are considered to be within the scope of the invention. Thus the scope of the invention should be determined by the appended claims and their legal equivalents, rather than by the examples given.

I claim:

1. A standup paddleboard comprising a right board slidingly connected to at least one interlocking sliding means and a left board slidingly connected to at least one interlocking sliding means interlocking sliding means, wherein said interlocking sliding means is embedded in said right board and said interlocking, sliding means is embedded in said left board, wherein said sliding means limits relative movement between said right board and said left board only to movement within the horizontal plane of said paddleboard that is parallel with the long axis of said paddleboard, such that substantially no relative movement is permitted within the vertical or transverse planes and no lateral movement is permitted within the horizontal plane of said paddleboard, and such that the lateral distance between said right board and said left board is affixed, wherein forceful movement of a standing user's legs and feet forcefully and reciprocably slide said right board and said left board fore and aft, and wherein at least one paddle is connected to the bottoms of each of said right board and said left board, and wherein said paddle rotates to a deployed position when either said right board or said right board slides aft, and wherein said paddle rotates to a non-deployed position when either said right board or said left board slides fore.

2. The paddleboard of claim 1, wherein said right board is slidingly connected to at least one slider and said left board is slidingly connected to at least one channel.

3. The paddleboard of claim 1, wherein said right board and said left board are releasably lockingly affixable when said right board and said left board are aligned to form a symmetrical paddleboard having the appearance and function of a standard paddleboard.

* * * * *